US007831020B2

(12) United States Patent
Inazuru

(10) Patent No.: US 7,831,020 B2
(45) Date of Patent: Nov. 9, 2010

(54) X-RAY TUBE AND X-RAY SOURCE INCLUDING IT

(75) Inventor: Tutomu Inazuru, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 168 days.

(21) Appl. No.: 12/089,086

(22) PCT Filed: Oct. 3, 2006

(86) PCT No.: PCT/JP2006/319770

§ 371 (c)(1),
(2), (4) Date: May 15, 2008

(87) PCT Pub. No.: WO2007/043391

PCT Pub. Date: Apr. 19, 2007

(65) Prior Publication Data

US 2009/0161830 A1 Jun. 25, 2009

(30) Foreign Application Priority Data

Oct. 7, 2005 (JP) ..... 2005-295718

(51) Int. Cl.
*H01J 35/06* (2006.01)

(52) U.S. Cl. ..... 378/136; 378/140

(58) Field of Classification Search ..... 378/136, 378/137, 138, 140

See application file for complete search history.

(56) References Cited

U.S. PATENT DOCUMENTS

| | | | | |
|---|---|---|---|---|
| 5,008,917 | A | 4/1991 | Behling et al. | |
| 5,077,771 | A | 12/1991 | Skillicorn et al. | |
| 5,563,923 | A | 10/1996 | Okada et al. | |
| 6,229,876 | B1 * | 5/2001 | Enck et al. | 378/136 |
| 6,351,520 | B1 * | 2/2002 | Inazaru | 378/138 |
| 6,381,305 | B1 * | 4/2002 | Okada et al. | 378/137 |
| 6,735,282 | B2 * | 5/2004 | Matsushita et al. | 378/138 |

FOREIGN PATENT DOCUMENTS

| | | |
|---|---|---|
| JP | 55-90039 | 7/1980 |
| JP | 3-155029 | 7/1991 |
| JP | 11-224625 | 8/1999 |

* cited by examiner

*Primary Examiner*—Chih-Cheng G Kao
(74) *Attorney, Agent, or Firm*—Drinker Biddle & Reath LLP

(57) ABSTRACT

The present invention relates to an X-ray tube, having a structure for realizing improvement of a magnification factor of a magnified transmission image, and an X-ray source that includes the X-ray tube. The X-ray tube includes: a target housing unit, housing an X-ray target; and an electron gun housing unit, one end of which is mounted to a side wall portion of the target housing unit. The electron gun housing unit is disposed so that a tube axis thereof intersects a tube axis of the target housing unit. The electron gun housing unit holds an electron gun while a center of an electron emission exit of the electron gun is shifted more toward an X-ray emission window side, disposed at one end of the side wall portion of the target housing unit, than the tube axis of the electron gun housing unit.

6 Claims, 13 Drawing Sheets

X-RAY TUBE AND X-RAY SOURCE INCLUDING IT

TECHNICAL FIELD

The present invention relates to an X-ray tube taking out X-rays generated therein to an exterior, and an X-ray source in which the X-ray tube and a power supply unit are configured integrally.

BACKGROUND ART

X-rays are electromagnetic waves that are highly transmitted through objects and are frequently used for nondestructive, noncontact observation of internal structures of objects. Normally with an X-ray tube, X-rays are generated by making electrons, emitted from an electron gun, incident on a target. As described in Patent Document 1, with an X-ray tube, a tubular member (referred to hereinafter as an "electron gun housing unit"), housing an electron gun, is mounted onto a housing member (referred to hereinafter as a "target housing unit") that houses a target. A tube axis of the target housing unit and a tube axis of the electron gun housing unit are orthogonal to each other, and the electrons, emitted from the electron gun, collide with the target and X-rays are generated from the target. The X-rays are transmitted through an X-ray emission window of the X-ray tube and irradiated onto a sample disposed at an exterior. The X-rays transmitted through the sample are captured by any of various X-ray imaging means.

Patent Document 1: U.S. Pat. No. 6,229,876

DISCLOSURE OF THE INVENTION

Problems that the Invention is to Solve

The present inventors have examined the conventional X-ray tubes, and as a result, have discovered the following problems. That is, a magnification factor of a magnified transmission image, captured by any of various X-ray imaging means, is greater the shorter a distance (FOD: Focus Object Distance) from a position of incidence of electrons on the target (focal point position of X-rays) to the X-ray emission window for taking out the X-rays, generated at the target, to the exterior. This signifies that shortening of the FOD improves precision of inspection by nondestructive, noncontact observation, etc. It has thus been desired that the FOD be made short.

However, in order to make the FOD short in a conventional X-ray tube, the target must be brought close to the X-ray emission window side. In this case, the electron gun housing unit itself needs to be shifted toward the X-ray emission window side as well. In the conventional X-ray tube, in order to avoid making the electron gun housing unit protrude from the X-ray emission window even when the electron gun housing unit itself is shifted toward the X-ray emission window side, the electron gun housing unit needs to be made compact. However, because when the electron gun housing unit is made compact, an internal space of the electron gun housing unit becomes narrow, the electron gun that is housed in the internal space also needs to be made compact. Making of the electron gun compact raises not only a manufacturing issue in that it becomes difficult to manufacture components that constitute the electron gun with high precision but also a design issue of maintaining voltage withstand performance among the respective components. It is thus extremely difficult to realize an electron gun that is made compact even while providing a desired output. Also, when the internal space of the X-ray housing unit becomes narrow, it becomes difficult to house the electron gun and consequently, working efficiency of assembly of the X-ray tube becomes low. It was thus difficult to shorten the FOD while providing the desired output with the conventional X-ray tube.

The present invention has been developed to eliminate the problems described above. It is an object of the present invention to provide an X-ray tube with a structure, which, by enabling shortening of FOD while providing a desired output from an electron gun, realizes an improved magnification factor for a magnified transmission image, and an X-ray source including the X-ray tube.

Means for Solving the Problems

An X-ray tube according to the present invention generates X-rays at an X-ray target by making electrons be emitted from an electron gun and be incident on the X-ray target. To achieve the above object, the X-ray tube according to the present invention comprises, at least, a target housing unit, and an electron gun housing unit mounted onto the target housing unit. The target housing unit is a hollow member having a tube axis extending along a predetermined direction and housing the X-ray target in its interior. The target housing unit includes: a side wall portion, disposed so as to surround the tube axis; and an X-ray emission window, being for taking out the X-rays, generated at the X-ray target, to an exterior and disposed at a surface, positioned at an end side of the side wall portion and intersecting the tube axis. Meanwhile, the electron gun housing unit is a hollow member having one end mounted onto the side wall portion of the target housing unit so that a tube axis thereof intersects the tube axis of the target housing unit. The electron gun housing unit has a structure housing at least a part of the electron gun while an electron emission exit of the electron gun is directed toward the X-ray target.

Specifically, in the X-ray tube according to the present invention, the electron gun housing unit holds the electron gun while a center of the electron emission exit of the electron gun is shifted more toward the X-ray emission window side than the tube axis of the electron gun housing unit. Put in another way, the target housing unit and the electron gun housing unit are respectively tubular, hollow members and a centerline of the electron gun (a tube axis of the electron gun that passes through the electron emission exit center of the electron gun) that is parallel to the tube axis of the electron gun housing unit is offset toward the X-ray emission window side from the tube axis of the electron gun housing unit.

Because, as described above, in the present X-ray tube, the centerline of the electron gun is offset toward the X-ray emission window side with respect to the tube axis of the electron gun housing unit, the FOD can be made short as compared with the conventional X-ray tube, with which the centerline of the electron gun is matched with the tube axis of the electron gun housing unit. As a result, the magnification factor of the magnified transmission image that is captured can be increased. Also, by moving just the position of the electron gun toward the X-ray emission window side, the need to make the electron gun housing unit compact is eliminated and an electron gun that provides an adequate, conventional output can be employed. Furthermore, by employment of the above-described positional structure of the electron gun, a workload for housing the electron gun in the electron gun housing unit is lightened and working efficiency of assembly of the X-ray tube is improved.

In the X-ray tube according to the present invention, the electron gun may have an electron generating unit, including a cathode that generates electrons, and a tubular focusing electrode, focusing while accelerating the electrons generated at the cathode. The electron gun housing unit may have a depressed portion which is provided at a position shifted toward the X-ray emission window side from the tube axis of the electron gun housing unit and which is fitted with a tip portion of the focusing electrode. In this case, the electron gun can be positioned by fitting the focusing electrode in the depressed portion formed in the electron gun housing unit. Thus by this structure, positioning of the electron gun is facilitated and the working efficiency of assembly of the X-ray tube is improved.

In the X-ray tube according to the present invention, outer peripheries of the electron generating unit and the focusing electrode are preferably connected via an insulator. In this case, the insulator is preferably positioned at a region of the outer periphery of the focusing electrode other than a region facing the X-ray emission window side. In this case, even if the electron gun is housed inside the electron gun housing unit in a state of being shifted toward the X-ray emission window side, the insulator is unlikely to be an obstacle and the electron gun can be disposed even closer to the X-ray emission window. As a result, the FOD can be shortened further.

In the X-ray tube according to the present invention, the electron gun housing unit may furthermore have a gas absorbing unit disposed in its interior. In particular, the gas absorbing unit is preferably disposed at a side farther away from the X-ray emission window than the electron gun in an internal space of the electron gun housing unit. In this case, because, a space, among the internal space of the electron gun housing unit, at the side farther away from the X-ray emission window than the electron gun can be made more spacious, it is easier to position the gas absorbing unit in this space. Effective use can thus be made of the internal space of the electron gun housing unit. The degree of freedom of selection is also increased in regard to size and installation position of the gas absorbing unit, and gas absorption, which is effective for maintaining a vacuum state in the electron gun housing unit, can be realized more effectively.

Furthermore, an X-ray source according to the present invention comprises the X-ray tube with the above-described structure (X-ray tube according to the present invention), and a power supply unit supplying a voltage, for generating X-rays at the X-ray target, toward the anode at which the X-ray target is disposed.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will be apparent to those skilled in the art from this detailed description.

EFFECTS OF THE INVENTION

In accordance with the X-ray tube according to the present invention, by employment of a structure for realizing shortening of the FOD while securing an adequate electron gun output, increase of a magnification factor of a magnified transmission image is enabled.

DESCRIPTION OF THE REFERENCE NUMERALS

Figure 1:
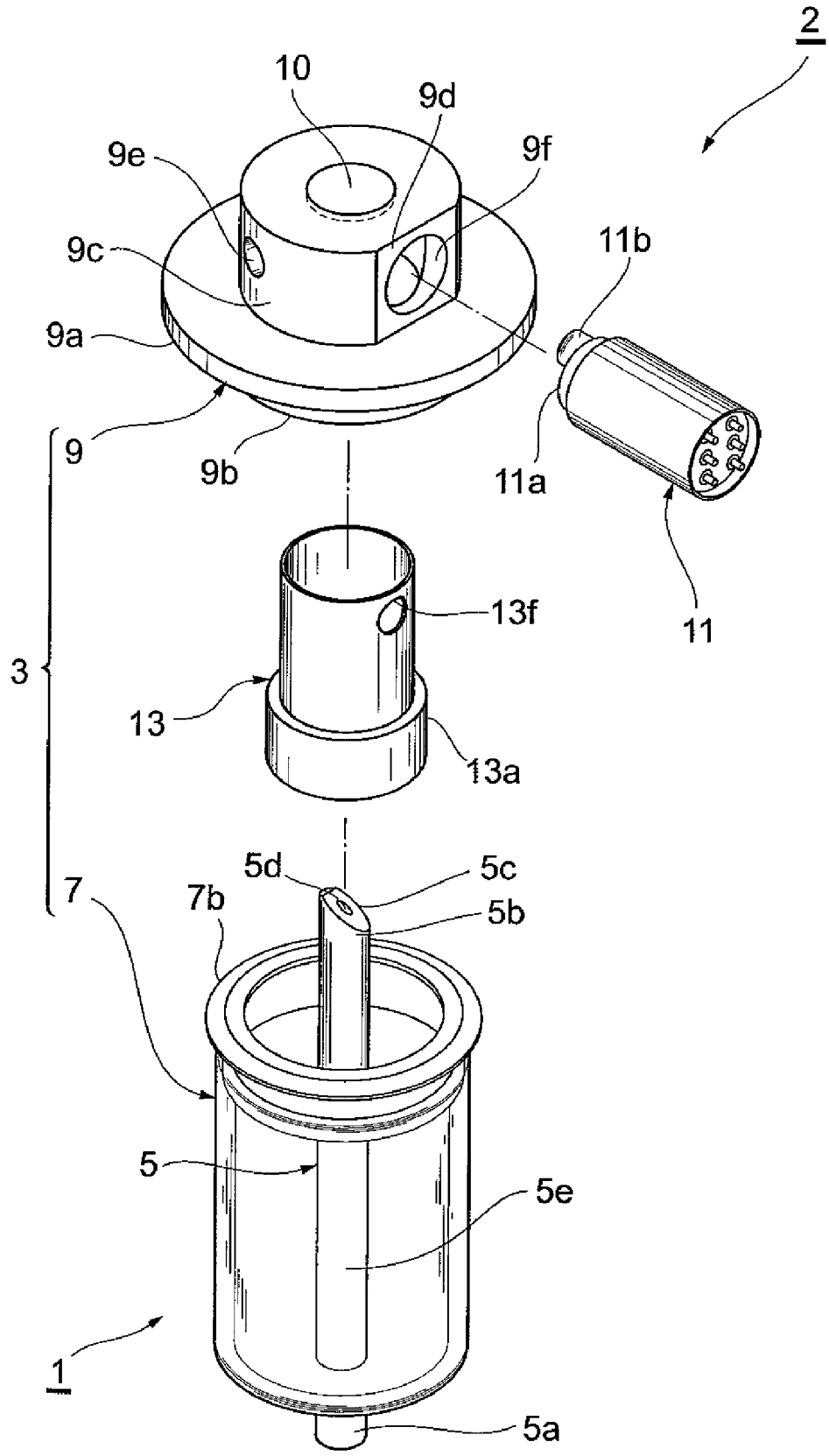
FIG. 1 is an exploded perspective view of an arrangement of an embodiment of an X-ray tube according to the present invention.

1 . . . X-ray tube; 3 . . . vacuum enclosure main body (target housing unit); 5 . . . anode; 5*d* . . . target; 7 . . . bulb; 9 . . . head; 13 . . . inner tube; 11 . . . electron gun housing unit; 11*b* . . . protruding portion; 11*c* . . . inner peripheral surface (depressed portion); 10 . . . X-ray emission window; 15 . . . electron gun; 17 . . . focusing electrode; 19, 35 . . . insulator; 21 . . . electron generating unit; 26 . . . cathode; 31 . . . getter (gas absorbing unit); L1 . . . X-ray emission path; C1 . . . electron gun housing unit tube axis; C4 . . . electron gun centerline; A1, A2 . . . X-ray emission window side region; 100 . . . X-ray source; 102 . . . power supply unit; 102A . . . insulating block; 102B . . . high voltage generating unit; 102C . . . high voltage line; 102D . . . socket; 103 . . . first plate member; 103A screw insertion hole; 104 . . . second plate member; 104A . . . screw insertion hole; 105 . . . fastening spacer member; 105A . . . screw hole; 106 . . . metal tubular member; 106A . . . mounting flange; 106B . . . relief surface; 106C . . . insertion hole; 108 . . . conductive coating; 109 . . . fastening screw; 110 . . . high voltage insulation oil; XC . . . X-ray camera; SP . . . sample plate; P . . . observation point; and XP . . . X-ray generation point.

BEST MODES FOR CARRYING OUT THE INVENTION

In the following, embodiments of an X-ray tube and an X-ray source including the X-ray tube according to the present invention will now be explained in detail with reference to FIGS. 1 to 13. In the description of the drawings, identical or corresponding components are designated by the same reference numerals, and overlapping description is omitted.

Figure 2:
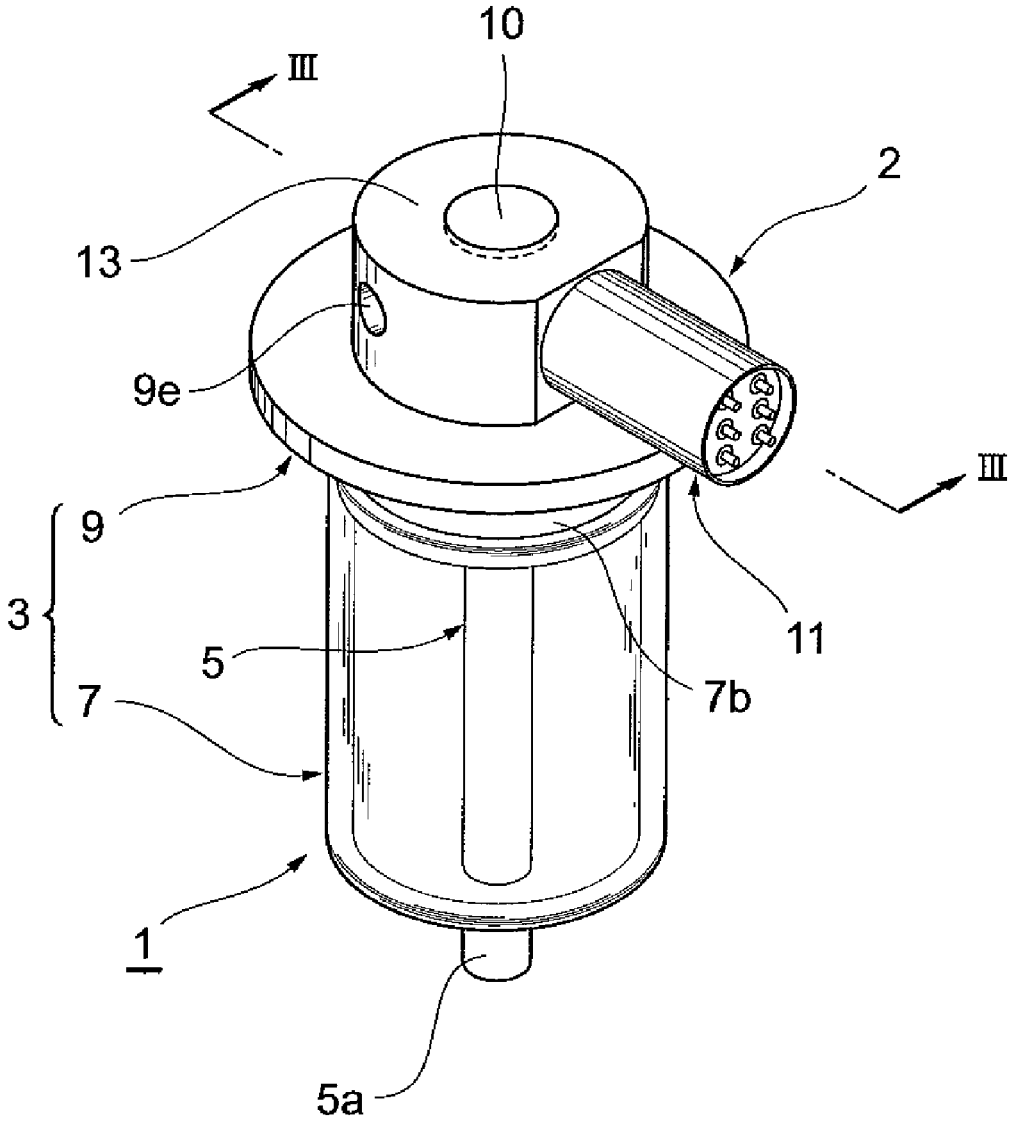
FIG. 2 is a perspective view of a general arrangement of the X-ray tube shown in FIG. 1.
Figure 3:
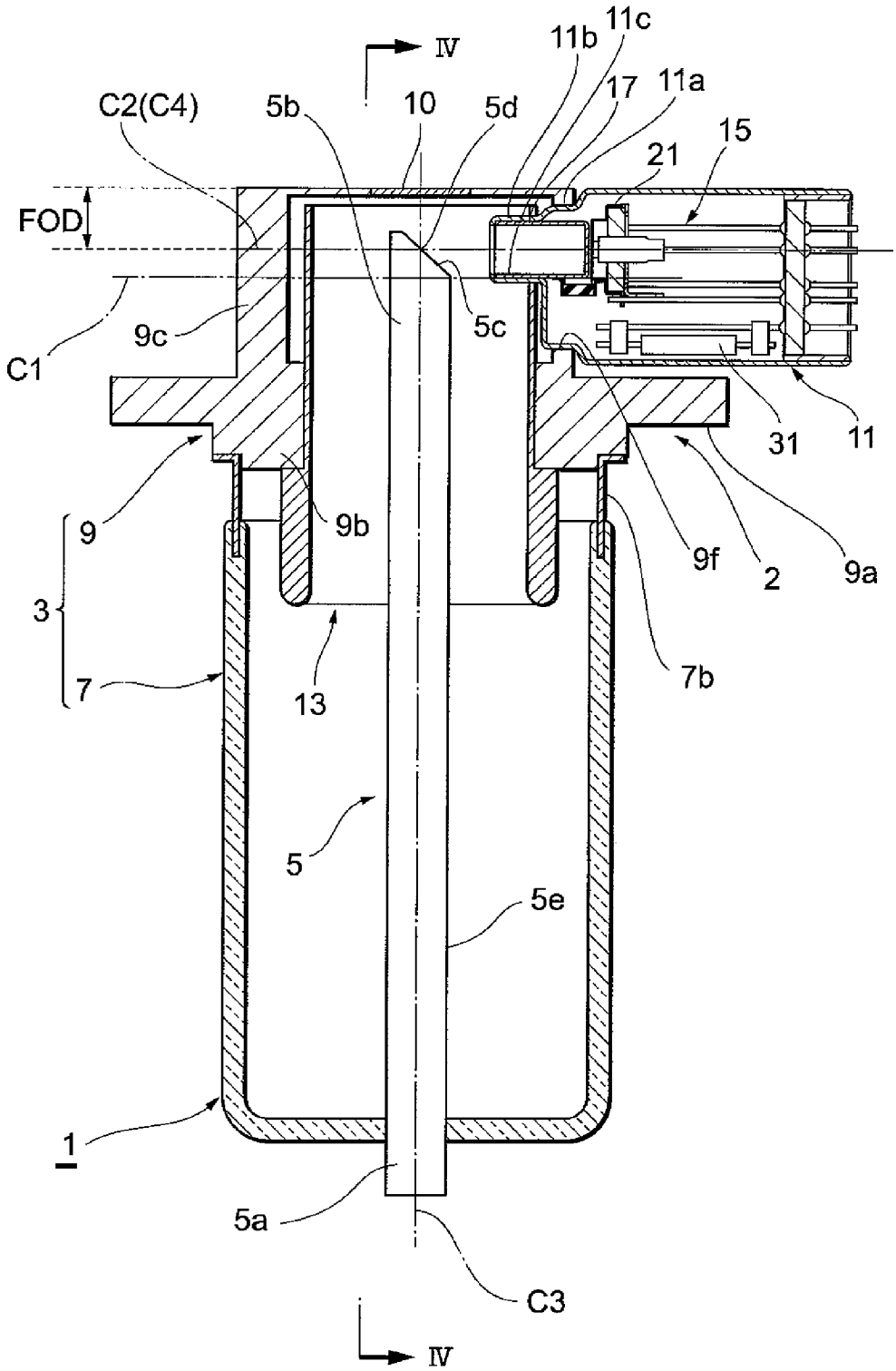
FIG. 3 is a sectional view of an internal structure of the X-ray tube according to the embodiment taken on line III-III in FIG. 2.
Figure 4:
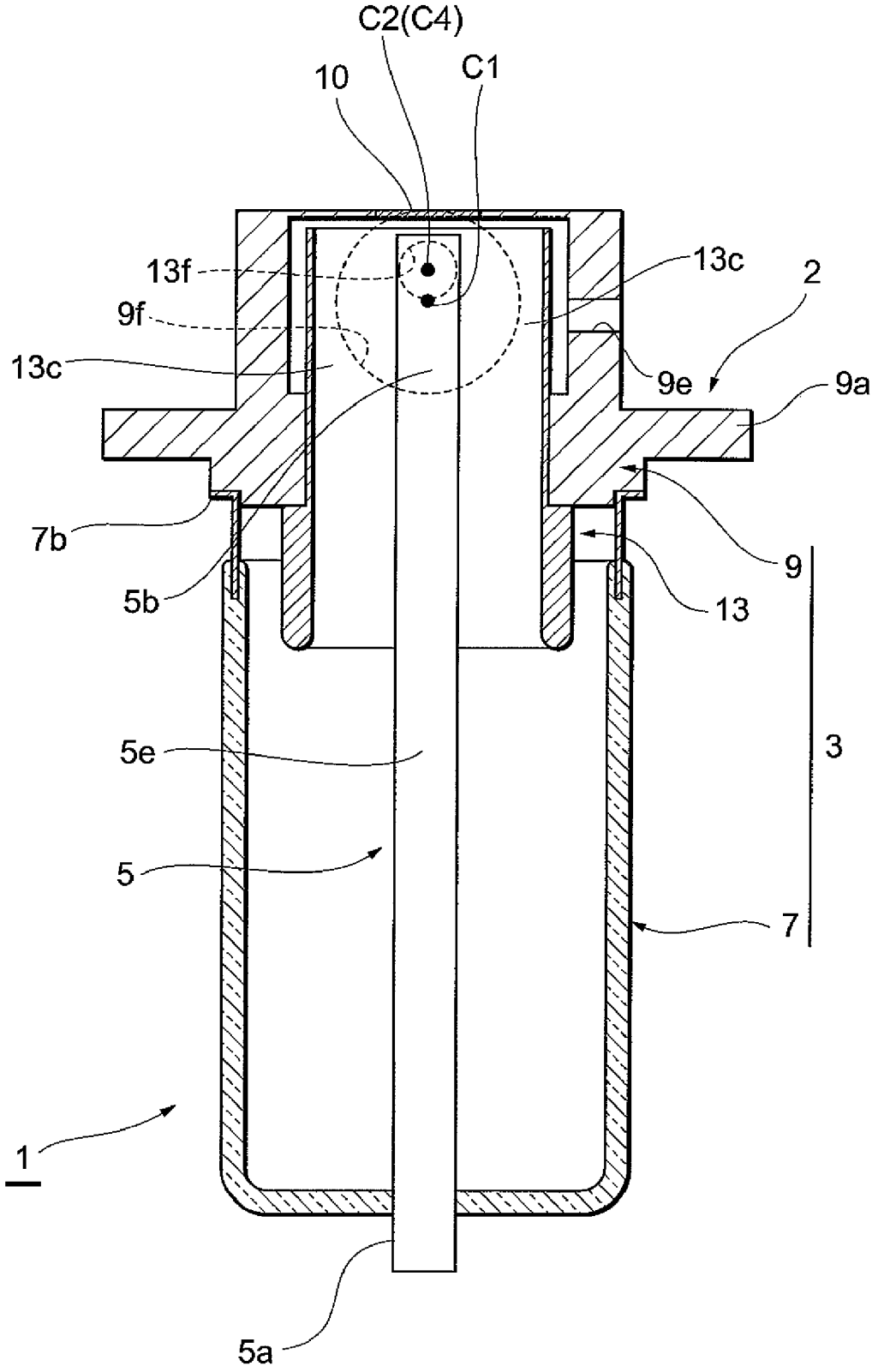
FIG. 4 is a sectional view of an internal structure of the X-ray tube according to the embodiment taken on line IV-IV in FIG. 3.
Figure 5:
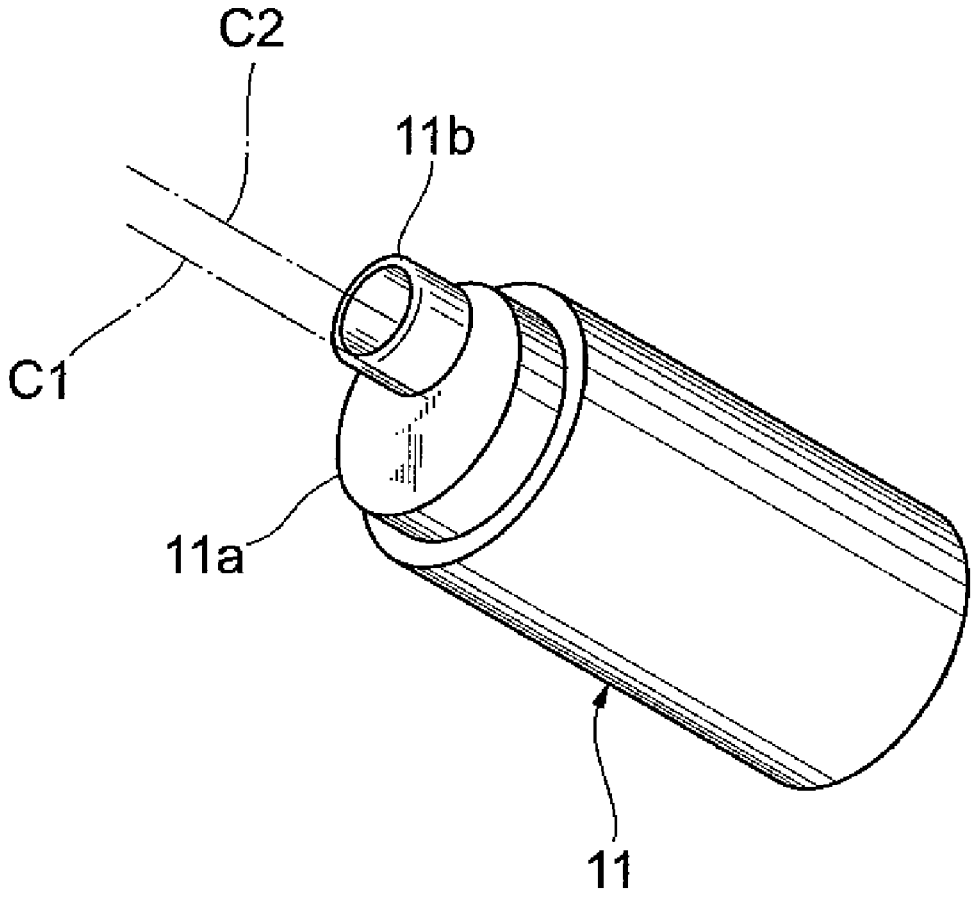
FIG. 5 is a perspective view of an electron gun housing unit applied to the X-ray tube according to the present invention.
Figure 6:
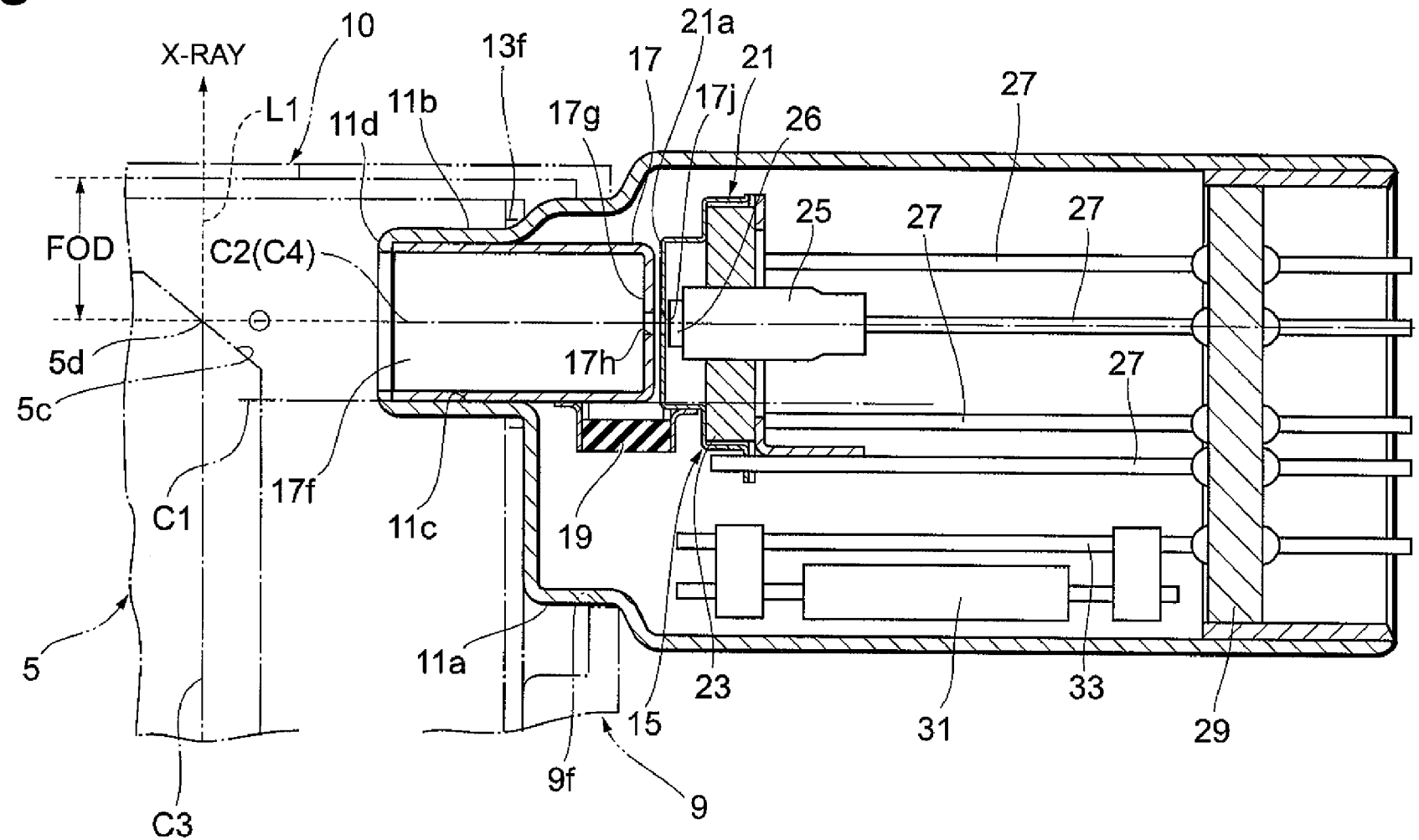
FIG. 6 is a sectional view of an internal structure of the electron gun housing unit and an electron gun.

First, an embodiment of an X-ray tube according to the present invention shall be described with reference to FIGS. 1 to 6. FIG. 1 is an exploded perspective view of an arrangement of the embodiment of the X-ray tube according to the present invention. FIG. 2 is a perspective view of a general arrangement of the X-ray tube shown in FIG. 1. FIG. 3 is a sectional view of an internal structure of the X-ray tube according to the embodiment taken on line III-III in FIG. 2. FIG. 4 is a sectional view of an internal structure of the X-ray tube according to the embodiment taken on line IV-IV in FIG. 3. FIG. 5 is a perspective view of an electron gun housing unit applied to the X-ray tube according to the present invention. FIG. 6 is a sectional view of an internal structure of the electron gun housing unit and an electron gun.

As shown in FIGS. 1 to 4, the X-ray tube 1 is a sealed X-ray tube. The X-ray tube 1 has a tubular vacuum enclosure main body 3 as a target housing unit. An anode 5, on which a target 5*d* to be described below is disposed, is housed in the vacuum enclosure main body 3, an interior of which is decompressed to a predetermined degree of vacuum. The vacuum enclosure main body 3 is constituted of a substantially cylindrical bulb 7, supporting the anode 5, a substantially cylindrical head 9, having an X-ray emission window 10, and a ring member 7*b*, connecting the bulb 7 and the head 9. A vacuum enclosure 2 is obtained by welding the electron gun housing unit 11 to the vacuum enclosure main body 3. The bulb 7 and the head 9 are fixed to the ring member 7*b* so as to have a tube axis C3 in common. The X-ray emission window 10 is disposed at one end of the head 9 in the tube axis C3 direction. Meanwhile, the other end in the tube axis C3 direction of the bulb 7, comprised of glass (insulator), has a shape that decreases in diameter in a form of closing an opening. By this structure, the anode 5 is held at a desired position inside the vacuum enclosure main body 3 with a part of a base end 5*a* (high voltage application portion) of the anode 5 being exposed to an exterior. The vacuum enclosure main body 3 thus has the X-ray emission window 10 at one end thereof and holds the anode 5 at the other end thereof. In the description that follows, upper and lower sides are defined so that one end side (the X-ray emission window 10 side) in the tube axis C3 direction of the vacuum enclosure main body 3 is the upper side and the other end side (the side at which the anode 5 is held) in the tube axis C3 direction of the vacuum enclosure main body 3 is the lower side.

The ring member 7*b* is fused to an upper end of the bulb 7. The ring member 7*b* is a cylindrical member comprised of metal and has an annular flange formed at its upper end. The upper end of the ring member 7*b* is put in contact with and welded to a lower end of the head 9.

The head 9 is metal member with a substantially cylindrical shape, and an annular flange 9*a* is formed on its outer periphery. The head 9 is divided into a lower portion 9*b* and an upper portion 9*c* across the flange portion 9*a*, and the ring member 7*b* is welded to a lower end of the lower portion 9*b* so as to share the tube axis C3 in common with the bulb 7. The X-ray emission window 10 comprised of a Be material is disposed at the upper portion 9*c* of the head 9 so as to close an opening of an end of the upper portion 9*c*. Furthermore, an exhaust port 9*e*, for putting an interior of the vacuum enclosure 2 into a vacuum state, is formed in the upper portion 9*c*, and an exhaust tube is fixed to the exhaust port 9*e*. Inside the head 9, a metal inner tube 13 of substantially cylindrical shape is disposed so as to share the tube axis C3 in common with the head 9.

A flat portion 9*d* is formed on an outer periphery of the upper portion 9*c* of the head 9, and a head side through hole 9*f*, for installation of the electron gun housing unit 11, is formed in the flat portion 9*d*. Meanwhile, an inner tube side through hole 13*f*, which is smaller in diameter than the head side through hole 9*f*, is formed for installation of the electron gun housing unit 11 in the inner tube 13, disposed inside the head 9. As viewed from the large-diameter head side through hole 9*f*, the small-diameter inner tube side through hole 13*f* is positioned inside the large-diameter head side through hole 9*f* at a position shifted to the X-ray emission window 10 side (see FIG. 4).

Also, as shown in FIGS. 3 and 5, the electron gun housing unit 11, in which the electron gun 15 is housed, is tubular and at one end of the electron gun housing unit 11 is disposed a protruding cylindrical neck 11*a*, which is reduced in diameter. A cylindrical protruding portion 11*b* is furthermore disposed on the neck 11*a*. The neck 11*a* is positioned so as to share the tube axis C1 in common with the electron gun housing unit 11, and a centerline C2 of the protruding portion 11*b* is parallel and shifted outward (toward the X-ray emission window 10 side) with respect to the tube axis C1 of the electron gun housing unit 11.

Furthermore as shown in FIGS. 4 and 6, the neck 11*a* of the electron gun housing unit 11 is fitted into the head side through hole 9*f* of the head 9, and the protruding portion 11*b* is fitted in the inner tube side through hole 13*f* of the inner tube 13. The electron gun housing unit 11 is thereby positioned in the head 9 in a manner such that the tube axis C1 of the electron gun housing unit 11 is substantially orthogonal to the tube axis C3 of the vacuum enclosure main body 3. The electron gun housing unit 11 is welded to the head 9. The electron gun 15 is housed inside the electron gun housing unit 11, and electrons emitted from the electron gun 15 collide with the target 5*d* and generate X-rays.

As shown in FIGS. 1 and 3, the bulb 7, the head 9, and the inner tube 13 are positioned so as to share the tube axis C3 in common. The anode 5 extends straight along the tube axis C3. The anode 5 is constituted of the target 5*d*, generating X-rays with a desired energy upon incidence of electrons, and a target support 5*e*, supporting the target 5*d* and supplying a voltage to the target 5*d*. The target support 5*e* is a cylindrical member comprised of copper and is held by the bulb 7 at the base end 5*a*. A tip 5*b* of the target support 5*e* is positioned in a region surrounded by the head 9 at the X-ray emission window 10 side. An inclined surface 5*c*, opposing the electron gun 15, is formed at the tip 5*b*, and in the inclined surface 5*c*, the disk-like target 5*d* comprised of tungsten is embedded so that an electron incidence surface thereof is parallel to the inclined surface 5*c*. When electrons are made incident on the target 5*d*, X-rays are generated from the target 5*d*. An emission path L1 (see FIG. 6) for taking out the X-rays to the exterior of the X-ray tube 1 extends along the tube axis C3 of the vacuum enclosure main body 3. The X-ray emission window 10 is disposed along the emission path L1 and the X-rays, transmitted through the X-ray emission window 10, are irradiated onto a sample.

In the X-ray tube 1, the target 5*d* is disposed at an electron incidence position, that is, a focal point of the X-rays. The shorter a distance (FOD) from the focal point to the X-ray emission window 10, the greater a magnification factor of a captured magnified transmission image and the higher a precision of an inspection performed by nondestructive, noncontact observation. Thus, in the X-ray tube 1, in order to shorten the FOD, an emission position of the electrons emitted from the electron gun 15 is set close to the X-ray emission window 10, and accordingly, the target 5*d*, disposed on the anode 5, is set close to the X-ray emission window 10.

Details of the electron gun 15 and the electron gun housing unit 11 that enable the emission position of the electrons emitted from the electron gun 15 to be set close to the X-ray emission window 10 shall now be described with reference to FIGS. 5 and 6.

As mentioned above, the neck 11*a* of the electron gun housing unit 11 is fitted into the head side through hole 9*f* of the head 9, and the protruding portion 11*b* is fitted in the inner tube side through hole 13*f* of the inner tube 13. By this structure, the electron gun housing unit 11 is positioned with respect to the head 9. The inner tube side through hole 13*f* is disposed at a position shifted toward the X-ray emission window 10 side from a center of the head side through hole 9*f*. The central axis line C2 of the protruding portion 11*b*, fitted into the inner tube side through hole 13*f*, is thus shifted in parallel toward the X-ray emission window 10 side with respect to the central axis line (tube axis of the electron gun housing unit 11) C1 of the neck 11*a*.

An inner peripheral surface 11*c* of the protruding portion 11*b* corresponds to being a depressed portion when viewed from an inner side of the electron gun housing unit 11, and a tip portion of a focusing electrode 17 of the electron gun 15 is fitted therein. The focusing electrode 17 is comprised of a metal with a shape of a cylinder with a bottom, and an end at the anode 5 side is opened so as to form a circular aperture 17*f* (corresponding to an electron emission exit of the electron gun 15). A central axis line of the focusing electrode 17, which is a centerline C4 of the electron gun 15, is matched with the central axis line C2 of the protruding portion 11*b*. A forefront tip 11*d* of the protruding portion 11*b* is formed so that its inner diameter is reduced, and by an inner peripheral surface of the forefront tip 11*d* being in contact with the tip portion of the focusing electrode 17, at which the aperture 17*f* is formed, positioning of the electron gun 15 in the centerline C4 direction is facilitated. Also, a through hole 17*h*, for passage of electrons, is formed at a center of a bottom 17*g*, disposed at the other end of the focusing electrode 17. The focusing electrode 17 is connected to an electron generating unit 21 via an insulator 19. The electron generating unit 21 has a disk-like grid electrode 21*a*, disposed close to the bottom 17*g* of the focusing electrode 17. The grid electrode 21*a* is formed to a cup-like form and has a through hole 17*j*, coaxial to the through hole 17*h*, at a part facing the bottom 17*g* of the focusing electrode 17. Furthermore, an insulator 23 is fixed to an interior of the grid electrode 21, and a heater 25 is fixed to the insulator 23. A cathode 26 is fixed to a tip of the heater 25, and the cathode 26 is positioned close to the grid electrode 21*a*. To the electron generating unit 21 are fixed straight stem pins 27 for holding the electron gun 15 at a desired position inside the electron gun housing unit 11 and supplying required power respectively to the members constituting the electron gun 15, and each stem pin 27 passes through a stem substrate 29, closing an end of the electron gun housing unit 11, and is exposed to the exterior.

When power is supplied from a stem pin 27 to the heater 25 and the cathode 26 is thereby heated, electrons are emitted from the cathode 26. Electrons, adjusted to a desired amount by the grid electrode 21*a*, then pass through the through hole 17*j* and the through hole 17*h*, are focused while being accelerated by the focusing electrode 17, and emitted from the aperture 17*f*, corresponding to being the electron emission exit of the electron gun 15. The centerline C4 of the electron gun 15 is parallel and shifted toward the X-ray emission window 10 side with respect to the tube axis C1 of the electron gun housing unit 11. The position of emission of the electrons emitted from the electron gun 15 can thus be set close to the X-ray emission window 10 without having to make the electron gun 15 compact. Accordingly, the position of the target 5*d* of the anode 5 can be set close to the X-ray emission window 10 and the FOD can be shortened.

The electrons emitted from the aperture 17*f* of the focusing electrode 17 collide with the target 5*d* while being accelerated to a high velocity by the anode 5, to which a positive high voltage is applied.

The X-rays, generated from the target 5*d* due to the collision of electrons, are transmitted through the X-ray emission window 10 and irradiated onto the sample. The X-rays transmitted through the sample are captured as a magnified transmission image of the sample by any of various X-ray imaging means. In the X-ray tube 1 according to the present invention, the FOD is made short as compared with the conventional X-ray tube and the magnification factor of the captured magnified transmission image is increased.

Figure 7:
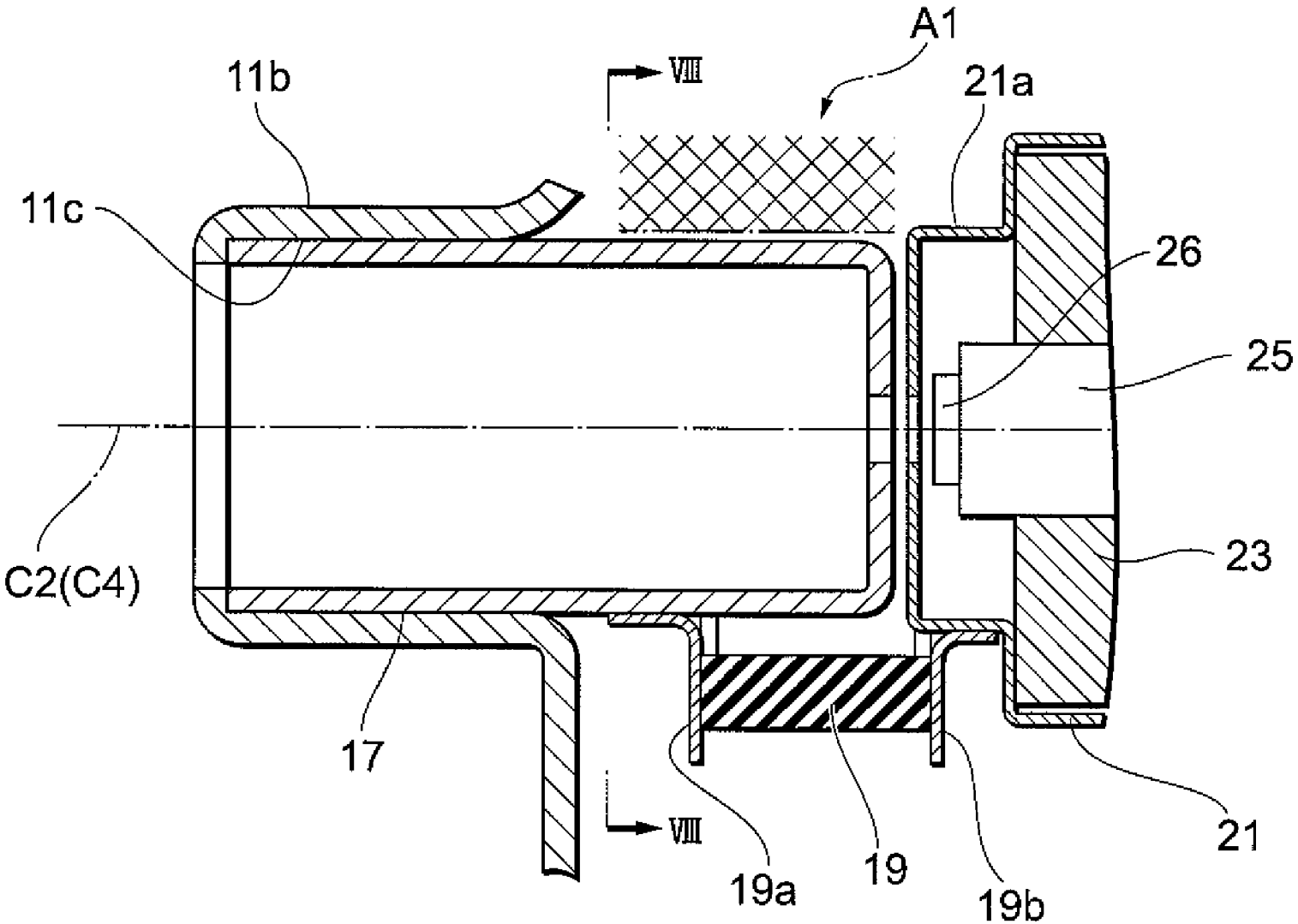
FIG. 7 is an enlarged sectional view of a focusing electrode and an electron generating unit that are connected via an insulator.
Figure 8:
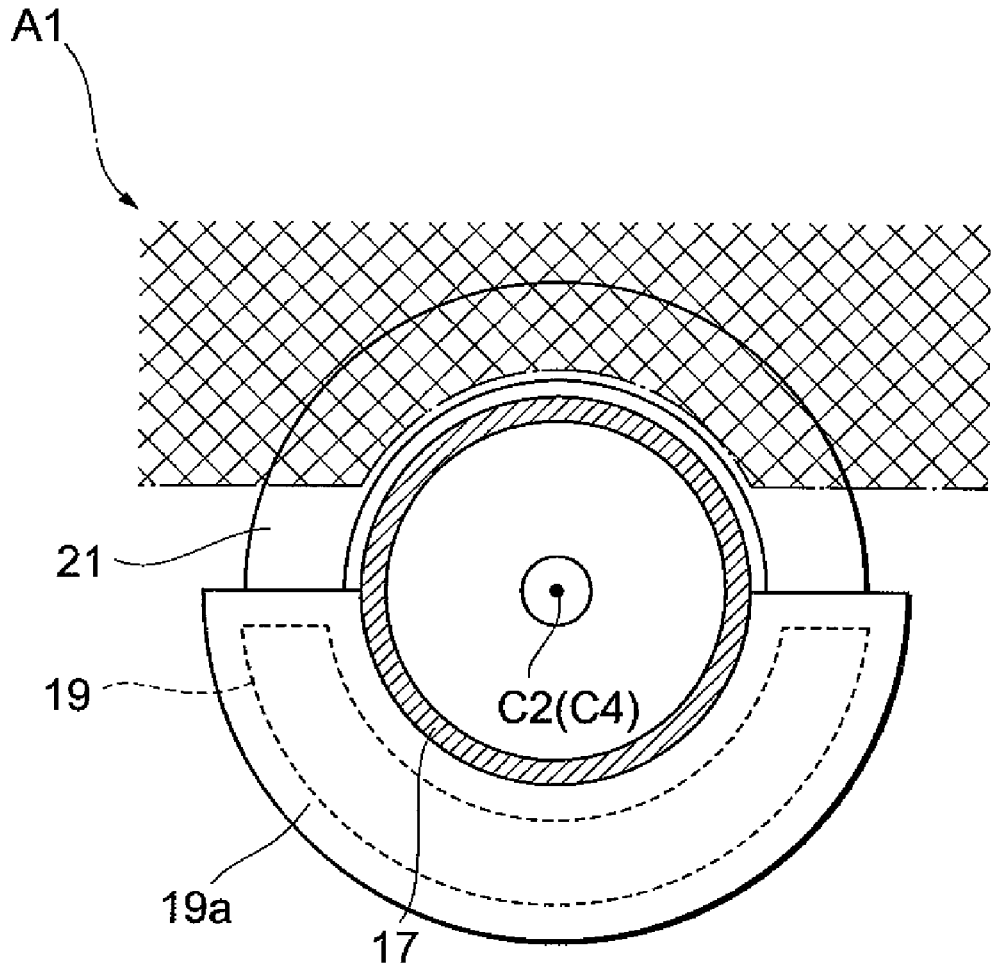
FIG. 8 is a sectional view of a connection structure shown in FIG. 7 taken on line VIII-VIII in FIG. 7.

The insulator 19, connecting the outer periphery of the focusing electrode 17 and the electron generating unit 21 and maintaining a mutual positional relationship of the two components shall now be described in detail with reference to FIGS. 7 and 8. FIG. 7 is an enlarged sectional view of the focusing electrode 17 and the electron generating unit 21 (including the cathode 26) that are connected via the insulator 19. FIG. 8 is a sectional view of the connection structure shown in FIG. 7 taken on line VIII-VIII in FIG. 7.

The insulator 19 comprised of ceramic or glass is disposed so as to avoid a region A1 (hatched portion in FIGS. 7 and 8), which, of the outer periphery of the focusing electrode 17, faces the X-ray emission window 10 side. Specifically, the insulator 19 is positioned at an approximately lower half region at a far side of the outer periphery of the focusing electrode 17 with respect to the X-ray emission window 10. By being fixed to arcuate legs 19*a* and 19*b*, the semi-cylindrical insulator 19 is positioned at a position separated by just predetermined distances from outer surfaces of the focusing electrode 17 and the electron generating unit 21. One leg 19*a* is welded to the outer surface of the focusing electrode 17 and the other leg 19*b* is welded to the outer surface of the grid electrode 21*a* of the electron generating unit 21.

When the insulator 19 is thus positioned so as to avoid the region A1 facing the X-ray emission window 10 side, the insulator 19 is less likely to be an obstacle in positioning the electron gun 15 inside the electron gun housing unit 11 in a state of being shifted toward the X-ray emission window 10 side. Also, the central line C4 of the electron gun 15 can be brought even closer to the X-ray emission window 10 side without making the electron gun 15 itself compact, and this is effective for making the FOD short while providing the desired output.

Figure 9:
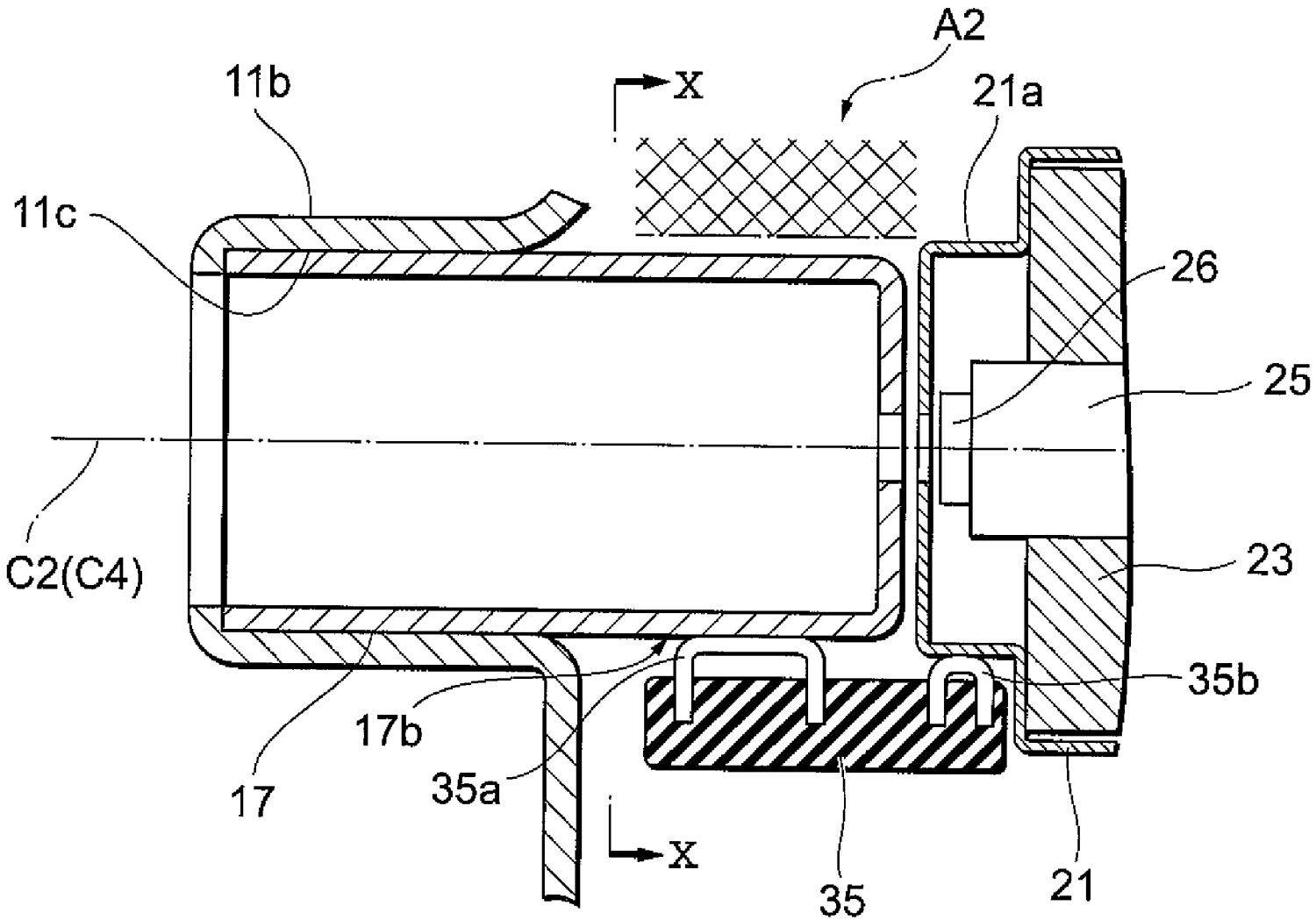
FIG. 9 is an enlarged sectional view of the focusing electrode and the electron generating unit that are connected via insulators as a modification example of the connection structure shown in FIG. 7.
Figure 10:
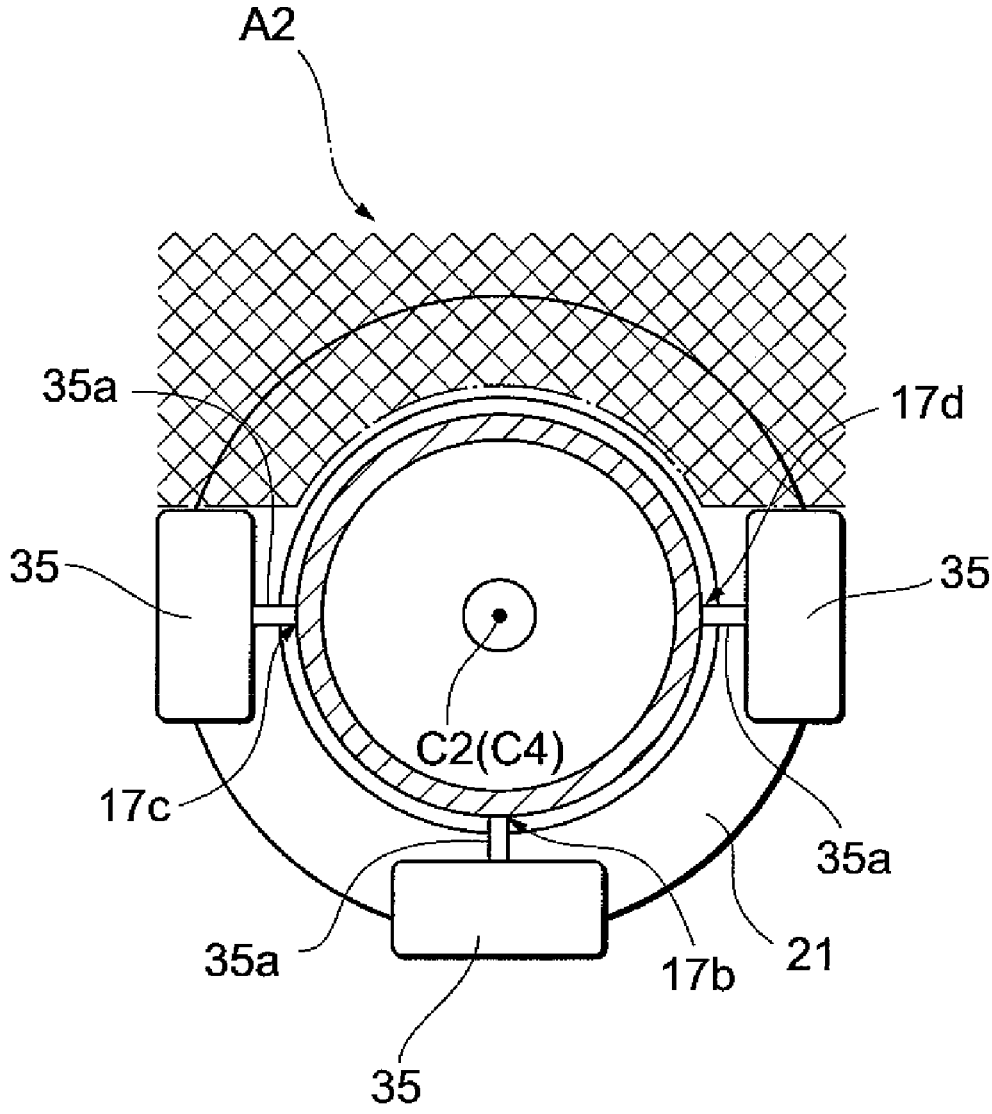
FIG. 10 is a sectional view of the connection structure of FIG. 9 taken on line X-X in FIG. 9.

As a modification example of the above-described embodiment to which the insulator 19 is applied, other insulators 35 shall now be described with reference to FIGS. 9 and 10. FIG. 9 is an enlarged sectional view of the focusing electrode 17 and the electron generating unit 21 (including the cathode 26) that are connected via the insulators 35 as the modification example of the connection structure shown in FIG. 7. FIG. 10 is a sectional view of the connection structure of FIG. 9 taken on line X-X in FIG. 9.

In similar to the insulator 19, the insulators 35 are also positioned in an approximately lower half region at the far side with respect to the X-ray emission window 10 so as to avoid a region A2 (hatched portion in FIGS. 9 and 10), which, of the outer periphery of the focusing electrode 17, faces the X-ray emission window 10 side. Two U-shaped legs 35*a* and 35*b* are fixed to each insulator 35 of rectangular parallelepiped shape. By this configuration, each insulator 35 is positioned at a position separated by just predetermined distances from the outer surfaces of the focusing electrode 17 and the electron generating unit 21. The insulators 35 are disposed at a total of three locations of: a position 17*b*, which is farthest from the X-ray emission window 10; and positions 17*c* and 17*d*, which are shifted from the position 17*b* to the left and right by just an angle of 90° centered at the tube axis C2 (C4). One leg 35*a* is welded to the outer surface of the focusing electrode 17 and the other leg 35*b* is welded to the outer surface of the grid electrode 21*a* of the electron generating unit 21.

When the insulators 35 are thus positioned so as to avoid the region A2 facing the X-ray emission window 10 side, the insulators 35 are less likely to be obstacles in positioning the electron gun 15 inside the electron gun housing unit 11 so as to be shifted toward the X-ray emission window 10 side. Also, the central line C4 of the electron gun 15 can be brought even closer to the X-ray emission window 10 side without making the electron gun 15 itself compact, and this is effective for making the FOD short while providing the desired output.

Although, in the present modification example, the insulators 35 are disposed at three locations, insulators may be disposed at two locations or at four or more locations. As an example in which insulators are disposed at two locations, insulators may be disposed at just the left and right positions 17*c* and 17*d* that are symmetrical across the central line C4 in FIG. 10. The positions are not restricted to the positions 17*c* and 17*d*, and insulators may be disposed at positions shifted more toward the side farther from the X-ray emission window 10 than the positions 17*c* and 17*d*. In this case, the two insulators are preferably equal in an angle formed by a segment joining the central line C4 and the position 17*b* farthest away from the X-ray emission window 10 and a segment joining the central line C4 and the corresponding insulator, with the angle being in a range of 80° to 60° and preferably 75° to 65°.

A getter 31, corresponding to being a gas absorbing unit shall now be described. As shown in FIG. 6, the getter 31 is a rod-like member comprised of zirconium or titanium. So as to be able to receive a supply of electricity, the getter 31 is fixed to a stem pin 33 inside the electron gun housing unit 11. By supplying electricity to the getter 31, the getter 31 is activated and made to exhibit a gas adsorbing function. In this case, the vacuum state (state of being decompressed to the predetermined degree of vacuum) of the interiors of the electron gun housing unit 11 and the vacuum enclosure main body 3 is maintained.

In the internal space of the electron gun housing unit 11, the getter 31 is disposed at a side farther away from the X-ray emission window 10 than the electron gun 15. Because in the X-ray tube 1, the electron gun 15 is disposed at the position shifted toward the X-ray emission window 10 side inside the electron gun housing unit 11, the space at the side farther away from the X-ray emission window 10 than the electron gun 15 is spacious. In this case, the getter 31 can be disposed readily and effective use can be made of the internal space. That is, the getter 31 can be made large and a degree of freedom of installation location is increased. The getter 31 of size and installation location favorable for maintaining the interiors of the electron gun housing unit 11 and the vacuum enclosure main body 3 in the vacuum state can thus be selected appropriately.

As described above, with the X-ray tube 1 according to the present invention, because the centerline C4 of the electron gun 15 is shifted more toward the X-ray emission window 10 side than the tube axis C1 of the electron gun housing unit 11, the target 5*d*, disposed on the anode 5, can be brought close to the X-ray emission window 10 and the FOD can be shortened. As a result, the magnification factor of the captured magnified transmission image is increased and the precision of inspection performed by nondestructive, noncontact observation is made high.

Also, in the X-ray tube 1, the FOD is shortened not by making the electron gun 15 compact but by shifting the position of the electron gun 15 toward the X-ray emission window 10 side in the electron gun housing unit 11. Making of the electron gun housing unit 11 compact can thus be restrained, and issues accompanying the making of the electron gun 15 compact, such as the manufacturing issue that it becomes difficult to manufacture components that constitute the electron gun 15 with good precision and the design issue of maintaining the voltage withstand performance among the respective components, are less likely to arise and the electron gun 15 of the desired output can be employed. Also because the making of the electron gun housing unit 11 compact can be restrained, the making of the stem substrate 29 compact can also be restrained, and a design load for determining the positions and number of the stem pins 27 and 33 that pass through the stem substrate 29 is lightened. Also, the workload for housing the electron gun 15 in the electron gun housing unit 11 is lightened and the working efficiency of assembly of the X-ray tube 1 is improved.

Also, in the X-ray tube 1, the position of the electron gun 15 is set by fitting the focusing electrode 17 of the electron gun 15 in the inner peripheral surface 11*c* of the protruding portion 11*b* of the electron gun housing unit 11. Positioning of the electron gun 15 inside the electron gun housing unit 11 is thus made easy. Also by fitting the focusing electrode 17 in the inner peripheral surface 11*c* of the protruding portion 11*b*, the focusing electrode 17 is held with stability in the electron gun housing unit 11. As a result, the entirety of the electron gun 15 can be held with stability inside the electron gun housing unit 11.

The present invention is not restricted to the above-described embodiment. For example, the material of the target 5*d* is not restricted to tungsten and may be any other X-ray generating material. The target 5*d* is not restricted to being disposed a part of the anode 5, and by forming the entirety of the anode 5 from a desired X-ray generating material, the anode 5 itself may be made the target. "Housing" in the case of housing the target 5*d* in the vacuum enclosure main body (target housing unit) 3 is not restricted to a case of housing the entirety of the target 5*d* and includes, for example in a case where the anode 5 itself is made the target, a state where a part of the target is exposed from the vacuum enclosure main body (target housing unit) 3. The tubular vacuum enclosure main body (target housing unit) 3 is not restricted to a circular, tube-like shape and may have a rectangular shape or other shape instead, and is also not restricted to having a straightly extending tube-like form and may have a curved or bent tube-like form. The intersection of the tube axis C3 of the vacuum enclosure main body (target housing unit) 3 and the tube axis C4 of the electron gun housing unit 11 is not restricted to a substantially orthogonal intersection and the axes may be inclined. The getter 31 may exhibit a gas adsorbing function without being supplied with electricity.

Figure 11:
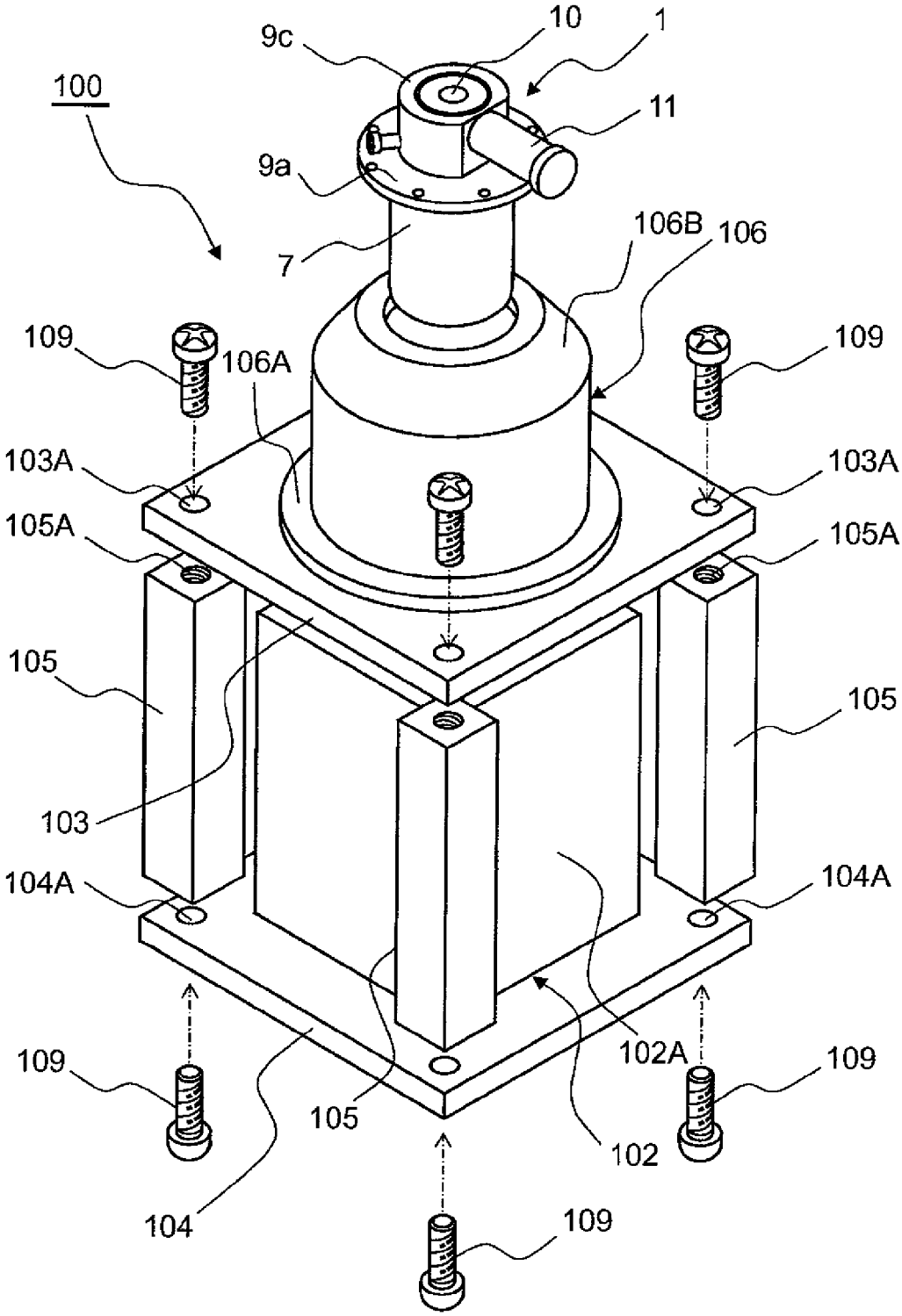
FIG. 11 is an exploded perspective view of an arrangement of an embodiment of an X-ray source according to the present invention.
Figure 12:
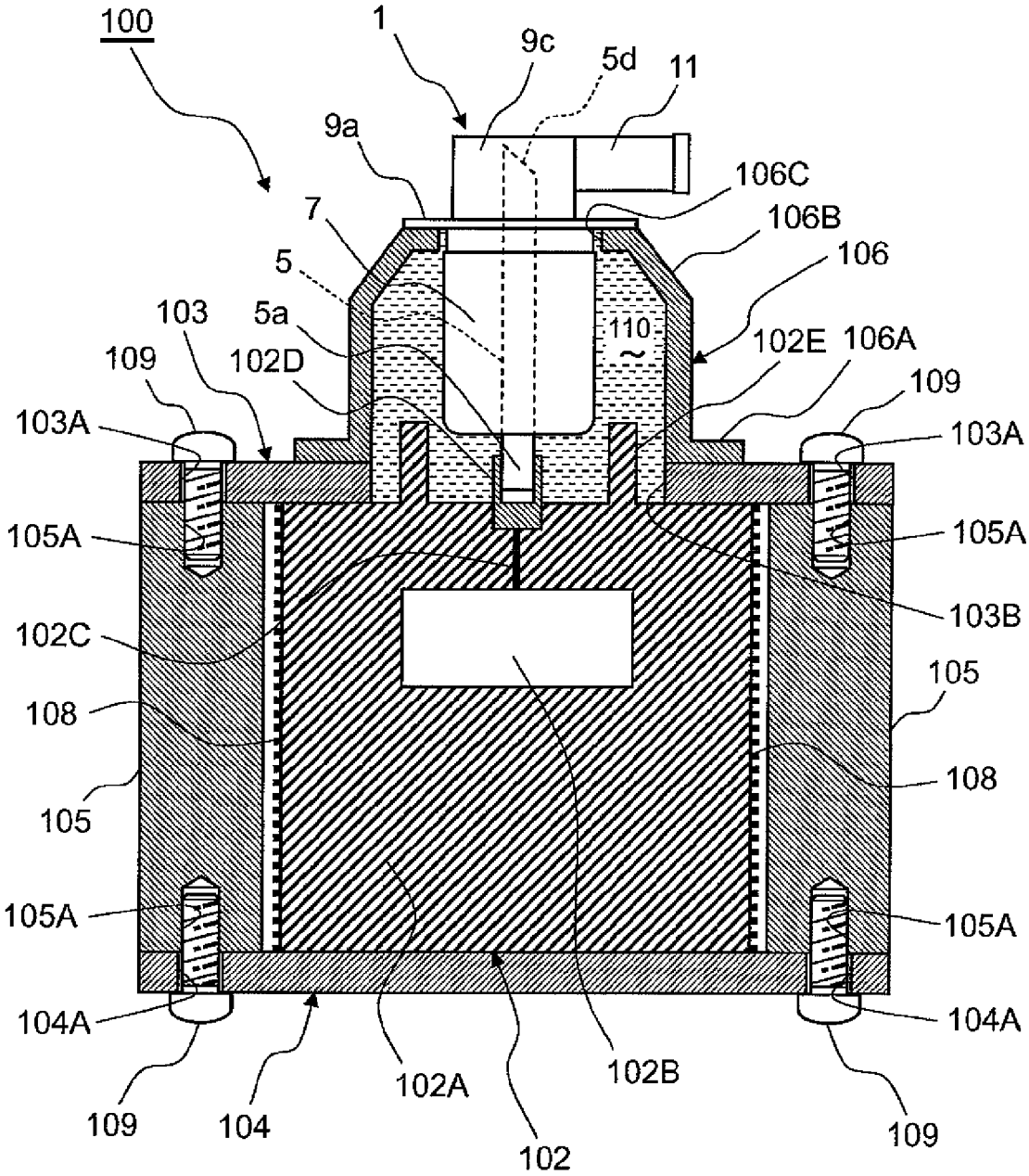
FIG. 12 is a sectional view of an internal structure of the X-ray source according to the embodiment.

An X-ray source 100 according to the present invention, to which the X-ray tube 1 with the above-described structure (X-ray tube according to the present invention) is applied, shall now be described with reference to FIGS. 11 and 12. FIG. 11 is an exploded perspective view of an arrangement of an embodiment of the X-ray source according to the present invention. FIG. 12 is a sectional view of an internal structure of the X-ray source according to the embodiment.

As shown in FIGS. 11 and 12, the X-ray source 100 includes a power supply unit 102, a first plate member 103, disposed at an upper surface side of an insulating block 102A of the power supply unit 102, a second plate member 104, disposed at a lower surface side of the insulating block 102A, four fastening spacer members 105, interposed between the first plate member 103 and the second plate member 104, and an X-ray tube 1, fixed above the first plate member 103 via a metal tubular member 106. The power supply unit 102 has a structure, with which a high voltage generating unit 102B, a high voltage line 102C, a socket 102D, etc., (see FIG. 12), are molded inside the insulating block 102A comprised of an epoxy resin.

The insulating block 102A of the power supply unit 102 has a short, rectangular column shape, with the mutually parallel upper surface and lower surface of substantially square shapes. At a central portion of the upper surface is disposed the cylindrical socket 102D, connected to the high voltage generating unit 102B via the high voltage line 102C. An annular wall portion 102E, positioned concentric to the socket 102D, is also disposed on the upper surface of the insulating block 102A. A conductive coating 108 is applied to peripheral surfaces of the insulating block 102A to make a potential thereof the GND potential (ground potential). A conductive tape may be adhered in place of coating the conductive coating.

The first plate member 103 and the second plate member 104 are members that, for example, act together with the four fastening spacer members 105 and eight fastening screws 109 to clamp the insulating block 102A of the power supply unit 102 in the vertical direction in the figure. The first plate member 103 and the second plate member 104 are formed to substantially square shapes that are larger than the upper surface and the lower surface of the insulating block 102A. Screw insertion holes 103A and 104A, for insertion of the respective fastening screws 109, are formed respectively at four corners of the first plate member 103 and the second plate member 104. A circular opening 103B, surrounding the annular wall portion 102E that protrudes from the upper surface of the insulating block 102A, is formed in the first plate member 103.

The four fastening spacer members 105 are formed to rectangular column shapes and are disposed at the four corners of the first plate member 103 and the second plate member 104. Each fastening spacer member 105 has a length slightly shorter than an interval between the upper surface and the lower surface of the insulating block 102A, that is, a length shorter than the interval by just a fastening allowance of the insulating block 102A. Screw holes 105A, into each of which a fastening screw 109 is screwed, is formed at upper and lower end surfaces of each fastening spacer member 105.

The metal tubular member 106 is formed to a cylindrical shape and has a mounting flange 106A formed at a base end thereof and fixed by screws across a sealing member to a periphery of the opening 103B of the first plate member 103. A peripheral surface at a tip of the metal tubular member 106 is formed to a tapered surface 106B. By the tapered surface 106B, the metal tubular member 106 is formed to a tapered shape without any corner portions at the tip. An opening 106C, through which a bulb 7 of the X-ray tube 1 is inserted, is formed in a flat, tip surface that is continuous with the tapered surface 106B.

The X-ray tube 1 includes the bulb 7, holding and housing the anode 5 in an insulated state, an upper portion 9*c* of the head 9, housing the reflecting type target 5*d* that is made electrically continuous with and formed at an inner end portion of the anode 5, and an electron gun housing unit 11, housing the electron gun 15 that emits an electron beam toward an electron incidence surface (reflection surface) of the target 5*d*. A target housing unit is formed by the bulb 7 and the head 9.

The bulb 7 and the upper portion 9*c* of the head 9 are positioned so as to be matched in tube axis, and these tube axes are substantially orthogonal to a tube axis of the electron gun housing unit 11. A flange 9*a*, for fixing to the tip surface of the metal tubular member 106, is formed between the bulb 7 and the upper portion 9*c* of the head 9. A base end 5*a* (portion at which a high voltage is applied from the power supply unit 102) of the anode 5 protrudes downward from a central portion of the bulb 7 (see FIG. 12).

An exhaust tube is attached to the X-ray tube 1, and a sealed vacuum container is formed by interiors of the bulb 7, the upper portion 9*c* of the head 9, and the electron gun housing unit 11 being depressurized to a predetermined degree of vacuum via the exhaust tube.

In the X-ray tube 1, the base end 5*a* (high voltage application portion) is fitted into the socket 102D molded in the insulating block 102A of the power supply unit 102. High voltage is thereby supplied from the high voltage generating unit 102B and via the high voltage line 102C to the base end 5*a*. When in this state, the electron gun 15, incorporated in the electron gun housing unit 11, emits electrons toward the electron incidence surface of the target 5*d*, X-rays, generated by the incidence of the electrons from the electron gun 15 onto the target 5*d*, are emitted from an X-ray emission window 10, fitted into an opening of the upper portion 9*c* of the head 9.

Here, the X-ray source 100 is assembled, for example, by the following procedure. First, the four fastening screws 109, inserted through the respective screw insertion holes 104A of the second plate member 104, are screwed into the respective screw holes 105A at the lower end surfaces of the four fastening spacer members 105. And by the four fastening screws 109, inserted through the respective screw insertion holes 103A of the first plate member 103, being screwed into the respective screw holes 105A at the upper end surfaces of the four fastening spacer members 105, the first plate member 103 and the second plate member 104 are mutually fastened while clamping the insulating block 102A in the vertical direction. A sealing member is interposed between the first plate member 103 and the upper surface of the insulating block 102A, and likewise, a sealing member is interposed between the second plate member 104 and the lower surface of the insulating block 102A.

A high voltage insulating oil 110, which is a liquid insulating substance, is then injected into an interior of the metal tubular member 106 from the opening 106C of the metal tubular member 106 that is fixed above the first plate member 103. The bulb 7 of the X-ray tube 1 is then inserted from the opening 106C of the metal tubular member 106 into the interior of the metal tubular member 106 and immersed in the high voltage insulating oil 110. In this process, the base end 5*a* (high voltage application portion) that protrudes downward from the central portion of the bulb 7 is fitted into the socket 102D at the power supply unit 102 side. The flange 9*a* of the X-ray tube 1 is then fixed by screwing across the sealing member onto the tip surface of the metal tubular member 106.

In the X-ray source 100, assembled by the above process, the annular wall portion 102E, protruded from the upper surface of the insulating block 102A of the power supply unit 102, and the metal tubular member 106 are positioned concentric to the anode 5 of the X-ray tube 1 as shown in FIG. 12. Also, the annular wall portion 102E protrudes to a height of surrounding and shielding the periphery of the base end 5*a* (high voltage application portion), which protrudes from the bulb 7 of the X-ray tube 1, from the metal tubular member 106.

In the X-ray source 100, when a high voltage is applied to the base end 5*a* of the X-ray tube 1 from the high voltage generating unit 102B of the power supply unit 102 and via the high voltage line 102C and the socket 102D, the high voltage is supplied to the target 5*d* via the anode 5. When in this state, the electron gun 15, housed in the electron gun housing unit 11, emits electrons toward the electron incidence surface of the target 5*d*, housed in the upper portion 9*c* of the head 9, the electrons become incident on the target 5*d*. The X-rays that are thereby generated at the target 5*d* are emitted to the exterior via the X-ray emission window 10, fitted onto the opening of the upper portion 9*c* of the head 9.

Here, in the X-ray source 100, the metal tubular member 106, housing the bulb 7 of the X-ray tube 1 in a state of being immersed in the high voltage insulating oil 110, is protruded from and fixed above the exterior of the insulating block 102A of the power supply unit 2, that is, the first plate member 103. A good heat dissipating property is thus realized, and heat dissipation of the high voltage insulating oil 110 inside the metal tubular member 106 and the bulb 7 of the X-ray tube 1 can be promoted.

The metal tubular member 106 has a cylindrical shape with the anode 5 disposed at the center. In this case, because the distance from the anode 5 to the metal tubular member 106 is made uniform, an electric field formed in a periphery of the anode 5 and the target 5*d* can be stabilized. The metal tubular member 106 can thus effectively discharge charges of the charged high voltage insulating oil 110.

Furthermore, the annular wall portion 102E, protruded on the upper surface of the insulating block 102A of the power supply unit 102, surrounds the periphery of the base end 5*a* (high voltage application portion), protruding from the bulb 7 of the X-ray tube 1, and thereby shields the base end 5*a* from the metal tubular member 106. Abnormal discharge from the base end 5*a* to the metal tubular member 106 is thus prevented effectively.

The X-ray source 100 has the structure with which the insulating block 102A of the power supply unit 102 is clamped between the first plate member 103 and the second plate member 104 that are fastened to each other via the four fastening spacer members 105. This means that conductive foreign objects that can induce discharge and charged foreign objects that can induce disruption of electric field are not present inside the insulating block 102A. Thus, in the X-ray source 100 according to the present invention, unwanted discharge phenomena and electric field disruptions in the power supply unit 102 are suppressed effectively.

Figure 13:
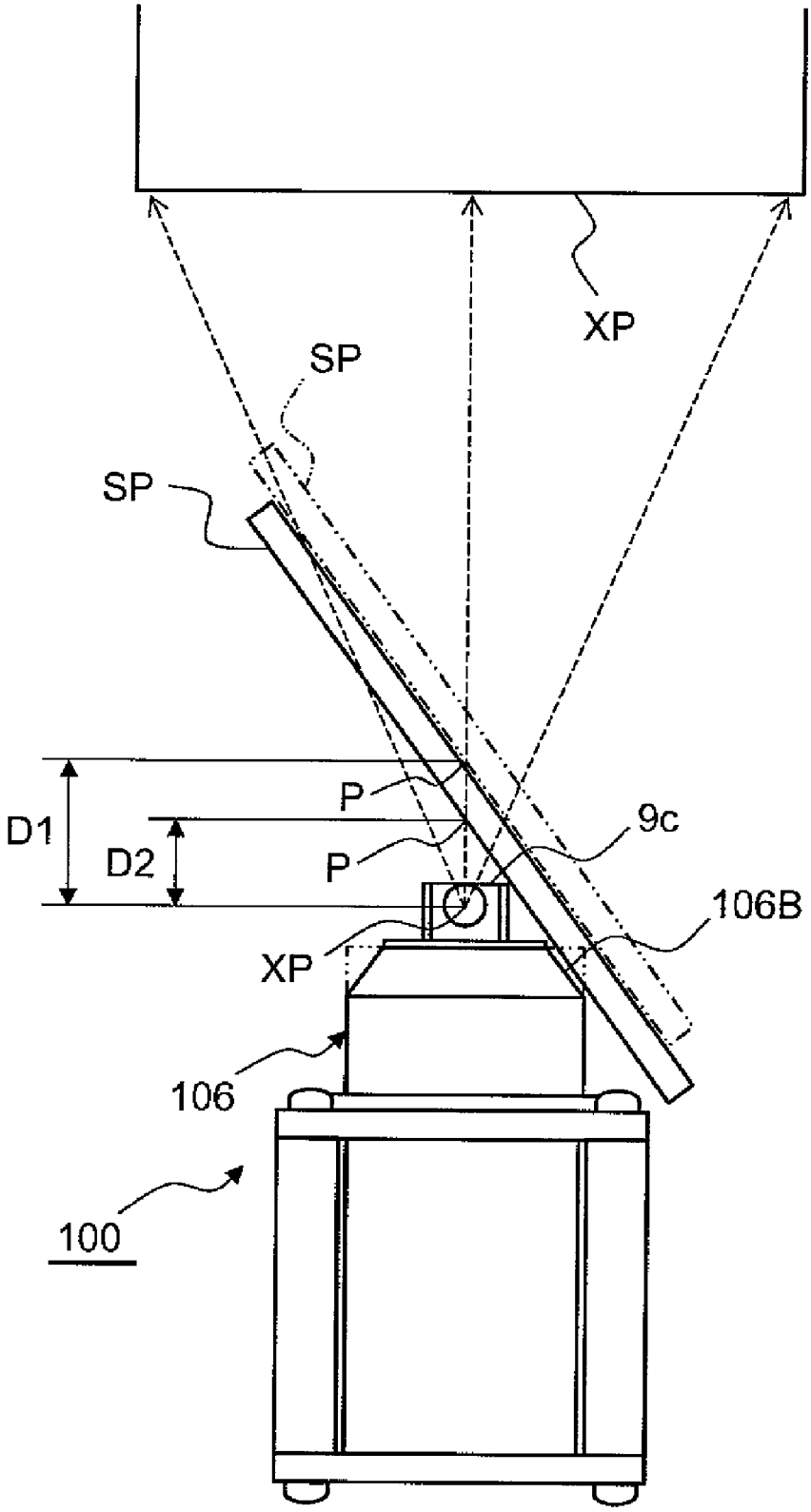
FIG. 13 is a front view for describing actions of the X-ray source (including the X-ray tube according to the embodiment) incorporated in an X-ray generating apparatus of a nondestructive inspection apparatus.

Here, the X-ray source 100 is incorporated and used, for example, in an X-ray generating apparatus that irradiates X-rays onto a sample in a nondestructive inspection apparatus, with which an internal structure of the sample is observed in the form of a transmission image. FIG. 13 is a front view for describing actions of an X-ray source (including the X-ray tube according to the embodiment) that is incorporated, as a usage example of the X-ray source 100, in an X-ray generating apparatus of a nondestructive inspection apparatus.

The X-ray source 100 irradiates X-rays to a sample plate SP, positioned between an X-ray camera XC and the X-ray source 100. That is, the X-ray source 100 irradiates X-rays onto the sample plate SP through the X-ray emission window 10 from an X-ray generation point XP of the target 5*d*, incorporated in the upper portion 9*c* of the head 9 that protrudes above the metal tubular member 106.

In such a usage example, because the shorter the distance from the X-ray generation point XP to the sample plate SP, the greater the magnification factor of the transmission image of the sample plate SP taken by the X-ray camera XC, the sample plate SP is normally positioned close to the X-ray generation point XP. Also, to observe the internal structure of the sample plate SP three-dimensionally, the sample plate SP is inclined around an axis orthogonal to a direction of irradiation of the X-rays.

If, when an observation point P of the sample plate SP is to be observed three-dimensionally upon being brought close to the X-ray generation point XP while inclining the sample plate SP around the axis orthogonal to the direction of irradiation of the X-rays as shown in FIG. 13, corner portions, such as indicated by alternate long and two short dashes lines, are left at a tip of the metal tubular member 106 of the X-ray source 100, the observation point P of the sample plate SP can be made to approach the X-ray generation point XP only up to a distance, with which the sample plate SP contacts a tip corner portion of the metal tubular member 106, that is, only up to a distance at which a distance from the X-ray generating point XP to the observation point P becomes Dl.

On the other hand, in the X-ray source 100, with which the tip of the metal tubular member 106 is configured to have a tapered shape without a corner portion by the provision of the tapered surface 106B as shown in FIGS. 11 and 12, the observation point P of the sample plate SP can be made to approach the X-ray generation point XP to a distance, with which the sample plate SP contacts the tapered surface 106B of the metal tubular member 106 as indicated by solid lines FIG. 13, that is, to a distance at which the distance from the X-ray generating point XP to the observation point P becomes D2. As a result, the transmission image of the observation point P of the sample plate SP can be magnified further and nondestructive inspection of the observation point P can be performed more precisely.

The X-ray source 100 according to the present invention is not restricted to the above-described embodiment. For example, although a cross-sectional shape of an inner peripheral surface of the metal tubular member 106 is preferably circular, a cross-sectional shape of an outer peripheral surface of the metal tubular member 106 is not restricted to being circular and may be a rectangular shape or other polygonal shape. In this case, the peripheral surface of the tip of the metal tubular member can be formed to be an inclined surface.

The insulating block 102A of the power supply unit 102 may have a short, cylindrical shape, and the first plate member 103 and the second plate member 104 may correspondingly have disk shapes. The fastening spacer members 105 may have cylindrical shapes and the number thereof is not restricted to four.

The structure of the X-ray tube 1 may be a structure with which the electron gun is disposed inside the bulb 7.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The X-ray tube according to the present invention can be applied as an X-ray generating source in various X-ray imaging apparatuses that are frequently used for nondestructive, noncontact observations.

The invention claimed is:

1. An X-ray tube for generating X-rays at an X-ray target, by making electrons emitted from an electron gun incident on said X-ray target, said X-ray tube comprising:

a target housing unit including: a side wall portion being a hollow member having a tube axis extending along a predetermined direction and housing said X-ray target therein, said side wall portion being disposed so as to surround the tube axis; and an X-ray emission window, positioned at an end side of said side wall portion and disposed on a surface intersecting the tube axis, for taking out the X-rays generated at said X-ray target to an exterior; and an electron gun housing unit being a hollow member having one end mounted onto said side wall portion of said target housing unit so that a tube axis thereof intersects the tube axis of said target housing unit, said electron gun housing unit housing at least a part of said electron gun while an electron emission exit of said electron gun is directed toward said X-ray target, wherein said electron emission exit of said electron gun is arranged such that a center of said electron emission exit is positioned on a center axis of said electron gun, and wherein said electron gun is held by said electron gun housing unit while the center of said electron emission exit of said electron gun is shifted more toward said X-ray emission window side than the tube axis of said electron gun housing unit.

2. An X-ray tube according to claim 1, wherein said electron gun has an electron generating unit including a cathode that generates electrons, and a focusing electrode focusing while accelerating the electrons generated at the cathode, and wherein said electron gun housing unit has a depressed portion provided at a position shifted toward said X-ray emission window side from the tube axis of said electron gun housing unit, said depressed portion being fitted with a tip portion of said focusing electrode.

3. An X-ray tube according to claim 2, wherein outer peripheries of said electron generating unit and said focusing electrode are connected through an insulator, and wherein said insulator is positioned at a region of the outer periphery of said focusing electrode other than a region facing said X-ray emission window side.

4. An X-ray tube according to claim 1, wherein said electron gun housing unit furthermore has a gas absorbing unit disposed therein, and wherein said gas absorbing unit is disposed at a side farther away from said X-ray emission window than said electron gun, in an internal space of said electron gun housing unit.

5. An X-ray source comprising:

an X-ray tube according to claim 1; and a power supply unit supplying an X-ray generation voltage to said X-ray target.

6. An X-ray tube for generating X-rays at an X-ray target, by making electrons emitted from an electron gun incident on said X-ray target, said X-ray tube comprising:

a target housing unit including: a side wall portion being a hollow member having a tube axis extending along a predetermined direction and housing said X-ray target therein, said side wall portion being disposed so as to surround the tube axis; and an X-ray emission window, positioned at an end side of said side wall portion and disposed on a surface intersecting the tube axis, for taking out the X-rays generated at said X-ray target to an exterior; and an electron gun housing unit being a hollow member having one end mounted onto said side wall portion of said target housing unit so that a tube axis thereof intersects the tube axis of said target housing unit, said electron gun housing unit housing at least a part of said electron gun while an electron emission exit of said electron gun is directed toward said X-ray target, wherein said electron gun housing unit has a first opening for exposing said electron emission exit of said electron gun and a second opening opposing said first opening, and wherein a center of said first opening is shifted more toward said X-ray emission window side than the tube axis of said electron gun housing unit and a center of said second opening corresponds to the tube axis of said electron gun housing unit.

* * * * *